US005821966A

United States Patent [19]

Schell et al.

[11] Patent Number: 5,821,966

[45] Date of Patent: Oct. 13, 1998

[54] INK JET CARTRIDGE WITH IMPROVED SEALING BETWEEN INK CONTAINER AND PRINTHEAD

[75] Inventors: Richard P. Schell, Webster; Richard C. Keefe, Savannah; Vincent J. Ouellette, Fairport; Norman S. Edgett, Rochester; Dennis M. Lengyel, Hemlock, all of N.Y.

[73] Assignee: Xerox Corporation, Stamford, Conn.

[21] Appl. No.: 664,581

[22] Filed: Jun. 17, 1996

[51] Int. Cl.[6] ..... B41J 2/175; E06B 7/16

[52] U.S. Cl. ..... 347/86; 49/484.1

[58] Field of Search ..... 347/85, 86, 87; 49/495.1, 475.1, 484.1

[56] References Cited

U.S. PATENT DOCUMENTS

| | | | |
|---|---|---|---|
| Re. 32,572 | 1/1988 | Hawkins et al. | 156/626 |
| 4,571,599 | 2/1986 | Rezanka . | |
| 4,771,295 | 9/1988 | Baker et al. . | |
| 4,833,491 | 5/1989 | Rezanka . | |
| 4,928,126 | 5/1990 | Arai | 347/86 |
| 5,237,342 | 8/1993 | Saikawa et al. | 347/87 |
| 5,423,087 | 6/1995 | Edward et al. | 2/463 |
| 5,467,118 | 11/1995 | Gragg et al. | 347/87 |

*Primary Examiner*—N. Le
*Assistant Examiner*—Thinh Nguyen

[57] ABSTRACT

In one embodiment of an ink jet print cartridge wherein ink flows from an ink container to a printhead via an ink manifold which includes an ink pipe which projects into an outlet port in the ink container. The interface between the manifold and the outlet port is sealed by placing a foam member, in compression, between two adjoining surfaces. In one embodiment, the foam is a closed cell neoprene. In another embodiment, the foam is a dual membrane consisting of a first layer of closed cell foam laminated to an open cell foam. In a third embodiment, a member is used to both seal the pipe to outlet port interface and also to wipe the ink pipe clear of ink. A polyurethane member is affixed to the outside surface of the ink container adjacent the outlet port. The polyurethane member has an aperture with a diameter which is smaller than the outside diameter of the ink pipe. When the ink pipe is projected through the polyurethane member aperture, it causes the member to extend over the top surface of the ink pipe and into a sealing engagement thereon. Upon withdrawal of the pipe (or withdrawal of the container), the polyurethane acts as a wiper to wipe the surface of the ink pipe free of any residual ink.

5 Claims, 4 Drawing Sheets

INK JET CARTRIDGE WITH IMPROVED SEALING BETWEEN INK CONTAINER AND PRINTHEAD

BACKGROUND OF THE INVENTION AND MATERIAL DISCLOSURE STATEMENT

The present invention relates to ink recording devices and, more particularly, to an improved sealing between an ink supply container and a printhead housing.

Ink jet recording devices include one or more printheads which eject ink onto a print medium such as paper in controlled patterns of closely spaced dots. To form color images, multiple printheads are used, with each printhead being supplied with ink of a different color from an associated ink container. Thermal ink jet printing systems use thermal energy selectively produced by resistors located in capillary filled ink channels near channel terminating nozzles or orifices to vaporize momentarily the ink and form bubbles on demand. Each temporary bubble expels an ink droplet and propels it toward a recording medium. The printing system is generally incorporated in a carriage type printer. A carriage type printer generally has a relatively small printhead containing the ink channels and nozzles. The printhead is usually sealingly attached to an ink supply container and the combined printhead and container form a cartridge assembly which is reciprocated to print one swath of information at a time on a stationarily held recording medium, such as paper. After the swath is printed, the paper is stepped a distance equal to the height of the printed swath, so that the next printed swath will be contiguous therewith. The procedure is repeated until the entire page is printed.

Ink from the ink supply container is drawn by capillary action through an outlet port in the container and into a manifold fluidly connecting ink to the printhead. The manifold supplies ink to the ink channels replenishing the ink after each ink ejection or firing from the associated nozzle. It is necessary to ensure that the ink, as it exits the ink container, is prevented from flowing, or leaking, into another part of the printhead cartridge such as the printhead housing. Various methods are known to provide an effective sealing. U.S. Pat. No. (Des./92435) discloses a thin polyester film having an aperture therethrough which is bonded to the ink container and to the printhead.

In order to obtain a more effective withdrawal of ink from an ink tank, it is known to project an ink pipe manifold into the ink container so as to withdraw either liquid ink therefrom or ink from an ink impregnated foam member. U.S. Pat. No. 4,771,295 is representative of this type of ink withdrawal system.

One problem with withdrawal of the ink from the foam member system is the need to maintain a leak-proof seal between the manifold and the outlet port of the ink container. Any sealing material must be able to seal against differential pressure associated with the ink being supplied while maintaining compressive loading of the manifold against the ink container surface.

SUMMARY OF THE INVENTION

In one embodiment, the compression set (ability to return to initial compression state) is improved by using a dual membrane seal member which comprises a closed cell material (neoprene) and an open cell foam material laminated together by an adhesive. The closed cell material maintains a hermetic seal while the open cell foam provides the compressive memory required to impart the proper load on the ink tank during normal operation.

In another embodiment, the seal is formed by adhering a polyurethane member on the front face of the ink tank overlying the outlet port of the ink tank. The polyurethane member has an inside diameter that is smaller than the outside diameter of the manifold ink pipe. The ink pipe forces the polyurethane edges over the top surface; when the ink tank is withdrawn from the surface, the polyurethane member performs a wiping action on the ink pipe causing ink to remain with the ink tank rather than on the ends of the ink pipe from which the ink could drip and contaminate the print assembly housing.

The present invention is, therefore, generally related to a print cartridge for an ink jet printer comprising at least one ink container fluidly connected to at least one printhead, an improved sealing means for preventing ink leakage, comprising in combination:

an ink manifold placed adjacent to an ink outlet port of said at least one ink container, said ink manifold including an ink pipe extending into said ink outlet port, and a foam sealing member placed between the ink manifold surface around the ink pipe and the container surface around said outlet port, said foam member characterized as a dual membrane comprising a first layer of a closed cell neoprene material bonded to a second layer of an open cell foam material.

The present invention further relates to the print cartridge which includes an ink manifold comprising a plurality of ink pipes which project into a plurality of ink containers, the print cartridge being used in a full color printer.

DESCRIPTION OF THE INVENTION

Figure 1:
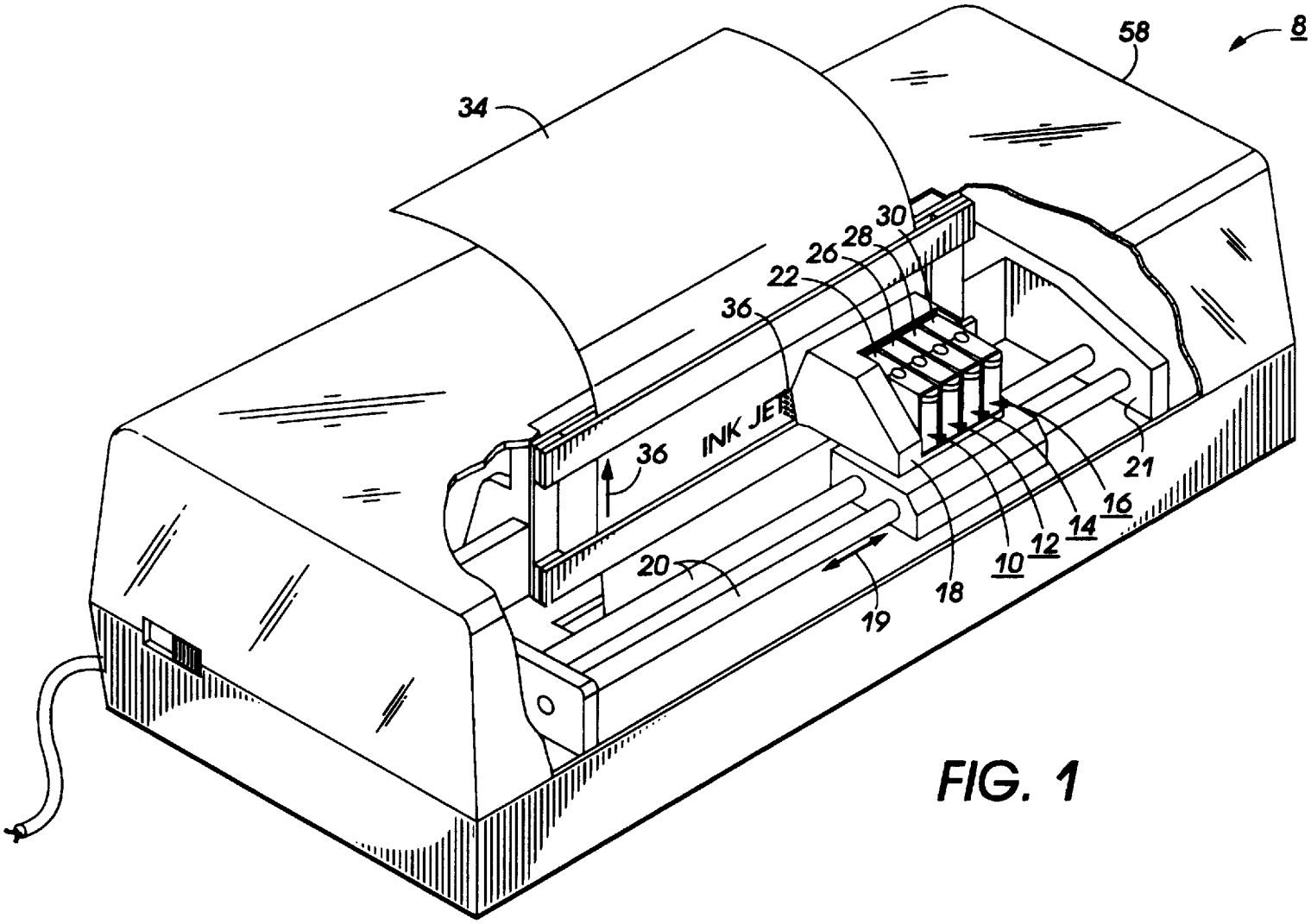
FIG. 1 illustrates a perspective view of a full color ink jet printer which incorporates the ink manifold to ink tank sealing members of the present invention.

FIG. 1 illustrates a perspective view of a full color thermal ink jet printer 8 which incorporates a preferred embodiment of the sealing member used to seal the ink passing from an ink container to an ink pipe manifold. Printer 8 is exemplary only. The invention can be practiced in other types of thermal ink jet printers as well as other reproduction devices such as piezoelectric printers, dot matrix printers and ink jet printers driven by signals from a document Raster Input Scanner. Printer 8 includes four ink jet printhead cartridges 10, 12, 14, 16 mounted on a carriage 18 supported by carriage rails 20. The carriage rails are supported by a frame 21 of the ink jet printer 8. Each printhead cartridge comprises an ink container containing ink for supply to a thermal ink jet printhead which selectively expels droplets of ink under control of electrical signals received from a controller (not shown) of the printer 8 through an electrical cable (not shown).

Thus, cartridge 10 comprises ink container 22 and printhead 24; cartridge 12 comprises ink container 26 and an associated printhead 27; cartridge 14 comprises ink container 28 and an associated printhead 29, and cartridge 16 comprises ink container 30 and an associated printhead 31. Each container contains a different color ink which is fluidly connected to an associated printhead by a manifold 42 shown in side view in FIG. 2 and an exploded view in FIG. 3. Each printhead comprises a plurality of ink channels which carry ink from the associated container to respective ink ejecting orifices or nozzles. When printing, the carriage 18 reciprocates back and forth along the carriage rails 20 in the direction of the arrow 19, the entire width traverse constitutes a scanning path. The actual printing zone is contained within the scanning path. As the printhead cartridges 10, 12, 14, 16 reciprocate back and forth along a print path and past a recording medium 34, such as a sheet of paper or a transparency, droplets of ink are expelled from selected ones of the printhead nozzles towards the sheet of paper. Typically, during each pass of the carriage 18 the recording medium 34 is held stationary. At the end of each pass, the recording medium 34 is stepped in the direction of the arrow 36. For a more detailed explanation of the operation of printer 8, reference is hereby made to U.S. Pat. Nos. 4,571,599, 4,833,491, and U.S. Pat. No. Reissue 32,572, which are incorporated herein by reference.

Figure 2:
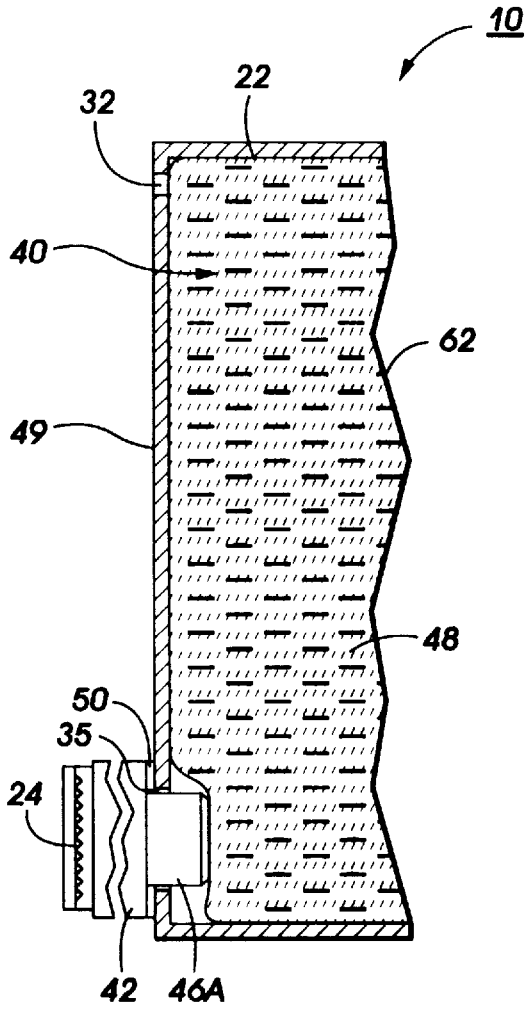
FIG. 2 is a cross-sectional view through one of the printhead cartridges shown in FIG. 1 showing a first embodiment of an ink sealing member.
Figure 3:
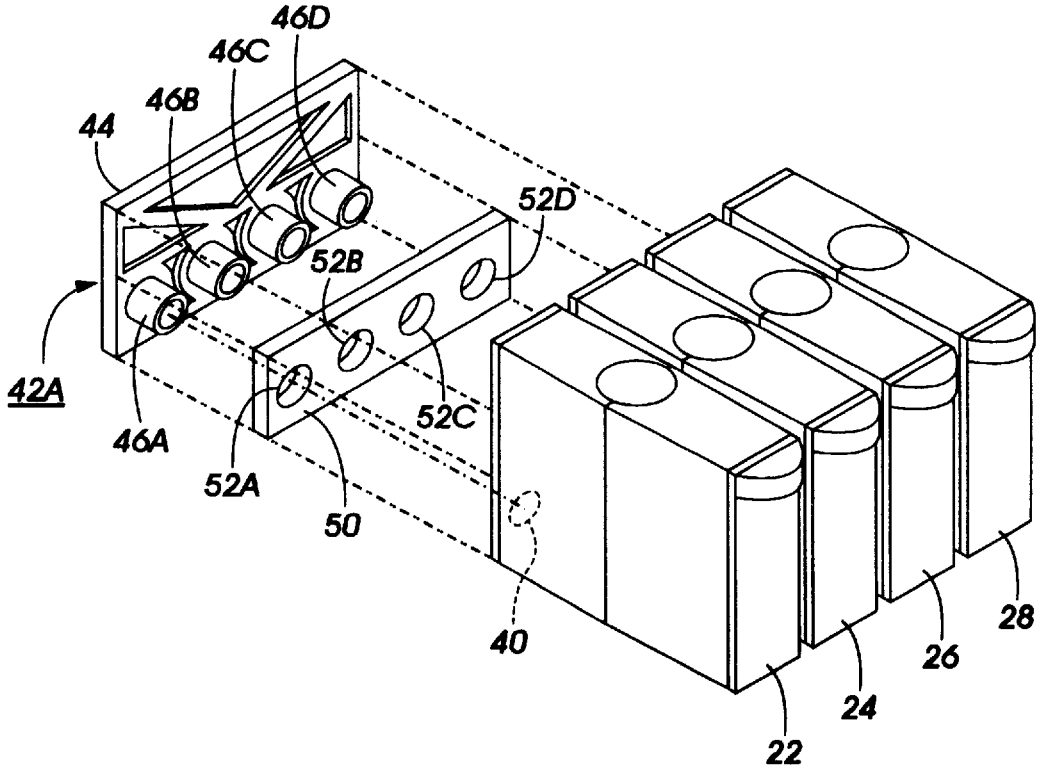
FIG. 3 is an exploded view of the manifold to ink tank arrangement of FIG. 1.

FIG. 2 shows a cross-sectional view of a portion of cartridge 10 showing ink container 22 having an outlet port 40. Manifold member 42, shown in the perspective exploded view of FIG. 3, comprises a plate 44 with ink pipes 46A–46D. The end of ink pipe 46A is engaged in compressive contact (by means not shown) with an ink impregnated foam member 48 in container 22. A foam member 50 has a plurality of apertures 52A–52D therethrough and is seated on manifold 42 so as to fit snugly over the ink pipes 46A–46D. When the manifold is in the operative position shown in FIG. 2, foam member 50 is compressed against the surface of container 22. In a preferred embodiment, the apertures create a 0.13 mm interference fit with the associated manifold pipe is formed. Member 50, in a preferred embodiment, is a closed cell neoprene which, under compression, provides an effective seal against ink migration leakage at the four ink port outlet/manifold interface.

Figure 4:
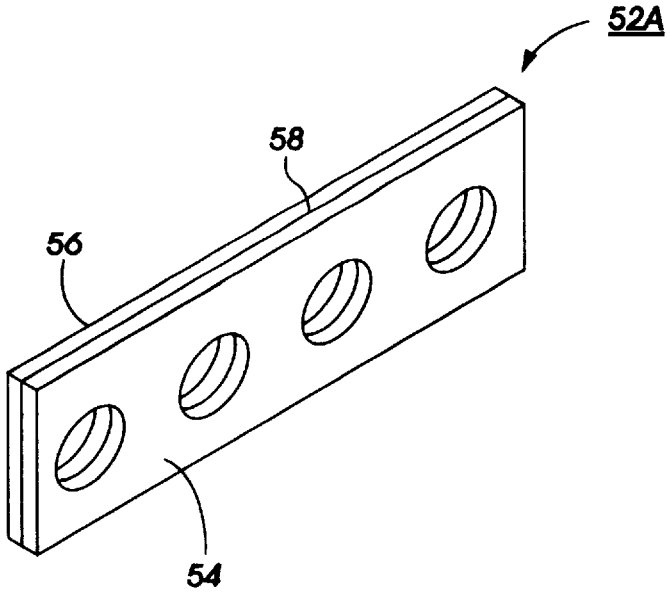
FIG. 4 is an alternate embodiment of the ink sealing member of FIG. 3.

Member 50 performs well with most inks, and can seal against differential pressures of ⁻10 in $H_2O$. However, the sealing efficiency decreases with repeated replacements of the ink container; e.g., it suffers from compression "set" and loses the ability to rebound to initial compression state. According to the invention, and in a second embodiment of the invention, a sealing member 52A, shown in perspective end view in FIG. 4, is a dual membrane seal member formed by bonding together a layer 54 of closed cell neoprene with a layer 56 of open cell foam by means of adhesive layer 58. Layer 54 provides the compatible ink seal while layer 56 provides the compressive memory required to impart the proper load on the ink tank container during operation.

Figure 5:
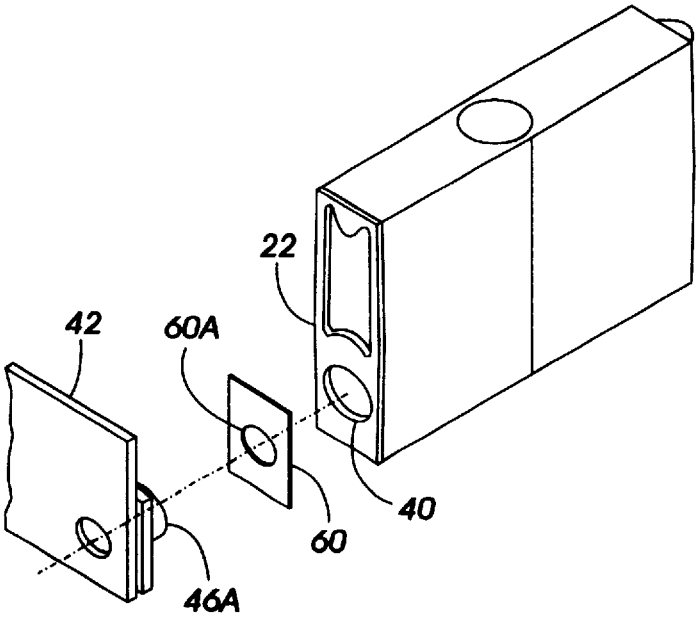
FIG. 5 shows a third embodiment of an ink sealing member.
Figure 6:
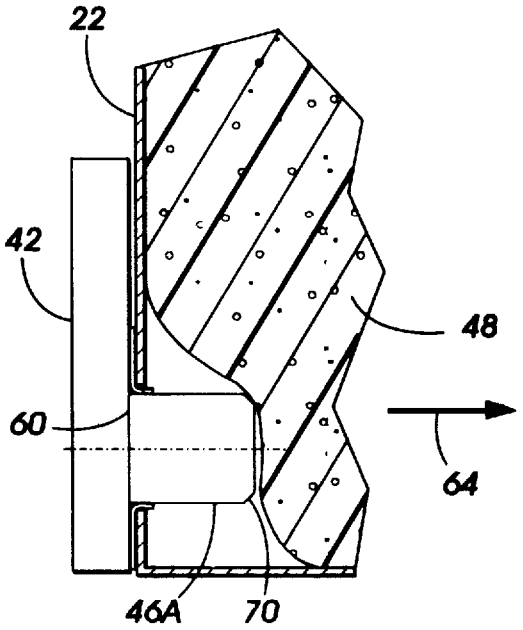
FIG. 6 shows a side view of a portion of FIG. 5.

With the above two embodiments, a continuing problem is the tendency for ink to remain on the manifold ink pipe when an ink container is removed following depletion. The ink is subject to dripping leading to possible system contamination. An alternative seal member is shown in exploded view in FIG. 5. A thin polyurethane sealing/wiping member 60 having an aperture 60A is affixed to the face of each container 22, 24, 26, 28. Each aperture 60A has an internal diameter smaller than the outside diameter of manifold ink pipes 46A–46D. For example, for an ink pipe diameter of 6.36 mm, the aperture diameter is 6.23 mm. FIG. 6 shows an end view of a seated ink pipe; the pipe pushes through aperture 60A effectively forcing the member 60 over the top of pipe 46A forming a seal in the contacted area. Upon withdrawal of container 22 (removed in the direction of arrow 64), following ink depletion therefrom, the member 60 acts as a wiper, wiping excess ink from the top surface of the ink pipe. The container and the member 60 with the excess ink is then discarded leaving no excess ink on the manifold.

A small chamfer 70 (FIG. 6) can be formed on the manifold inlet to aid in guiding the member 60 into position While the embodiment disclosed herein is preferred, it will be appreciated from this teaching that various alternative, modifications, variations or improvements therein may be made by those skilled in the art, which are intended to be encompassed by the following claims:

We claim:

1. A print cartridge for an ink jet printer comprising:

at least one ink container fluidly connected to at least one printhead, an ink manifold having at least one ink pipe extending into at least one outlet port of said ink container to provide an ink flow passage from said container to said printhead and a foam member having at least one aperture therethrough, said foam member seated on said manifold ink pipe to provide a seal between the ink manifold and the outlet port, said foam member characterized as being a dual membrane comprising a first layer of a closed cell neoprene material bonded to a second layer of an open cell foam material.

2. The print cartridge of claim 1 wherein said ink manifold comprises a plurality of ink pipes which project into a plurality of ink containers, the print cartridge being used in a full color printer.

3. The cartridge of claim 1 wherein said first and second layers are bonded together in a sandwich configuration.

4. A print cartridge for an ink jet printer comprising at least one ink container fluidly connected to at least one printhead and an improved sealing means for preventing ink leakage, the sealing means comprising in combination:

an ink manifold placed adjacent an ink outlet port of said at least one ink container, said ink manifold including an ink pipe extending into said ink outlet port, and a polyurethane member affixed to the outside surface of said outlet port, said member having an aperture with a diameter therethrough slightly smaller than the outside diameter of said ink pipe whereby, when said ink pipe is introduced into said outlet port, said member is forced over the top of said ink pipe to form a seal around the pipe circumference and when said ink container is moved away from said manifold, said member wipes the circumference of the ink pipe free of any residual ink.

5. The print cartridge of claim 4 wherein said ink pipe has a chamfer formed thereon to aid in guiding said member into fixed position.

* * * * *